US005115839A

United States Patent [19]

Speich

[11] Patent Number: 5,115,839

[45] Date of Patent: May 26, 1992

[54] WEAVING MACHINE WITH RIBBON CUTTING DEVICE

[75] Inventor: Francisco Speich, Gipf-Oberfrick, Switzerland

[73] Assignee: Textilma AG

[21] Appl. No.: 358,378

[22] PCT Filed: Aug. 12, 1988

[86] PCT No.: PCT/CH88/00137

§ 371 Date: May 15, 1989

§ 102(e) Date: May 15, 1989

[87] PCT Pub. No.: WO89/02491

PCT Pub. Date: Mar. 23, 1989

[30] Foreign Application Priority Data

Sep. 21, 1987 [CH] Switzerland ..... 3631/87
Mar. 18, 1988 [CH] Switzerland ..... 1056/88

[51] Int. Cl.[5] ..... D03J 1/08

[52] U.S. Cl. ..... 139/291 C; 156/515

[58] Field of Search ..... 139/291 R, 291 C, 302; 156/515, 88, 148, 251; 28/170

[56] References Cited

U.S. PATENT DOCUMENTS 3,901,289 8/1975 Filter et al. ..... 139/291 C
3,961,650 6/1976 Marowsky .
4,124,420 11/1978 Pastorelli et al. .
4,571,245 2/1986 Gachsay ..... 139/291 C

FOREIGN PATENT DOCUMENTS 2302949 7/1974 Fed. Rep. of Germany .
2905621 8/1980 Fed. Rep. of Germany .

OTHER PUBLICATIONS

"Trennschweissen mit Ultraschall", Melliand Textilberichte, 2/1985, p. 110.

*Primary Examiner*—Andrew M. Falik
*Attorney, Agent, or Firm*—Toren, McGeady & Associates

[57] ABSTRACT

A weaving machine includes a guide device for a woven material web. The guide device is arranged downstream of a filling thread set-up edge. The weaving machine further includes a ribbon cutting device for cutting the woven material web into ribbons and for melting on the cut edges. The cutting device is arranged between the guide device and a breast beam. The weaving machine also includes a thermal fixing device mounted independently of the cutting device. The guide device and the cutting device are arranged independently of one another and the fixing device is arranged on a take-up roller arranged downstream of the breast beam and/or on a guide roller immediately following the take-up roller.

24 Claims, 3 Drawing Sheets

WEAVING MACHINE WITH RIBBON CUTTING DEVICE

BACKGROUND OF THE INVENTION

The invention is directed to a weaving machine which includes a guide device for a woven material web. The guide device is arranged downstream of a filling thread set-up edge. The weaving machine further includes a ribbon cutting device for cutting the woven material web into ribbons and for melting on the cut edges so as to be secure against rippling. The cutting device is arranged between the guide device and a breast beam. The weaving machine also includes a thermal fixing device arranged independently of the cutting device.

It has already been known for a long time (DE-OS 1 535 330, U.S. Pat. No. PS 3 486 957, Textil-Praxis [Textile Practice] 1956, September, p. 951) to produce ribbons, particularly label ribbons, on weaving machines producing relatively wide woven material rather than on conventional ribbon weaving machines, since the production costs can accordingly be reduced to the extent that the printed labels used for inexpensive textiles can be economically competitive.

In theory, the production of woven ribbons by means of cutting a corresponding wide woven material web parallel to the warp thread presents no difficulties. In practice, however, quality goods cannot be achieved economically in one work cycle because of the shrinkage of the ribbons brought about by the different warp thread tensions and because of the encrusted separating edges of the ribbon.

In attempting to overcome these disadvantages, an arrangement is described in the DE-PS 2 302 949 and U.S. Pat. No. PS 3 961 650 whose solution consists in that all the devices which are already known, i.e. a spreader, a cutting device and a thermal fixing device are integrated in a condensed manner in a massive, specially constructed compact carrier beam extending over the entire width of the woven material. A very compact construction is accordingly achieved, but it does not overcome the aforementioned disadvantages, since the individual devices are rigidly arranged and their positions cannot be adjusted relative to one another. The compact construction greatly impedes accessibility and operation and, in addition, is susceptible to dirt because of the round rod of a clamping spreader inserted in a narrow groove which is practically closed, since the woven material web is drawn through this groove and is clamped at the entrance and discharge slots and accordingly strips off snarls and winds up loose threads. Another substantial disadvantage is that the disadvantageous shrinkage behavior and the encrusted separating edges of the ribbon cannot be eliminated by a hot wire arranged on one side above or below the ribbons, respectively. The compact construction does not allow any other solution for reasons of space, which means that the aforementioned disadvantages can also not be eliminated with this solution and the ribbon quality demanded on the commercial level can still not be achieved.

A device is known, in addition, from the U.S. Pat. PS 4 124 420 which cuts a wide woven material into ribbons. The device is an independent unit which is connected downstream of a breast beam of a weaving machine and comprises a plurality of deflecting rollers and a dancing or compensating device for maintaining a constant ribbon tension and ribbon speed at the cutting device. This device has the disadvantage that the guidance is impeded because of the long path of the woven material web, so that an accurate separation of the woven material web into individual ribbons according to pattern is not ensured.

SUMMARY OF THE INVENTION

It is the object of the present invention to improve a weaving machine of the type named in the beginning.

The proposed object is met, according to the invention, by arranging the guide device and the cutting device independently of each other and by arranging the fixing device on a take-up roller mounted downstream of the breast beam and/or on a guide roller immediately following the take-up roller.

The accessibility of the guide device and the cutting device is substantially improved in that the latter are arranged at the weaving machine so as to be separated from one another, i.e. they are not located at a common carrier, so that they are more easily accessible in the event of disturbances and adjusting work. In addition, these individual devices can be constructed in an optimal manner individually because they are arranged so as to be separate from one another, e.g. at the machine frame. Nevertheless, an optimal guidance of the woven material web, and accordingly an accurate cutting according to pattern, is achieved by means of the close arrangement of the cutting device to the guide device and accordingly to the filling thread set-up edge. The fixing device, which is connected downstream of the breast beam, enables optimal fixing conditions, wherein the guidance of the individual ribbons is no longer critical.

The weaving machine can comprise a deflecting rod system as guide device but a holding-down device, is more advantageous. Thus, the guide device includes a first guide shoulder which extends along the width of the woven material web. The first guide shoulder includes a guide edge and is arranged downstream of the filling thread set-up edge. A removable second guide shoulder with a second guide edge is mounted relative to the first guide shoulder such that the woven material web can be guided around the first and second guide shoulders in an S-shaped manner.

Since the woven material web is only guided around two guide edges by two guide shoulders in an S-shaped manner, the resistance of the woven material web in the guide device is relatively low and the woven material web can be guided in both directions via the guide device. Accordingly, a particularly simple construction of the guide device results, which is not susceptible to dust in practice and is easily accessible for maintenance and adjustment work. Nevertheless, the S-shaped guidance of the woven material web offers a sufficient holding-down and guidance of the woven material web at the filling thread set-up edge as well as a uniform smooth guidance for the cutting process, so that optimal production conditions are provided for the woven material web and the ribbons.

In accordance with another feature, the second guide shoulder is formed from individual segments covering a portion of the width of the woven material. This enables the guide shoulders to be favorably adapted to the woven material web. In accordance with another feature, the overlapping depths of the guide shoulders which engage one enables a particularly subtle adjustment of the guide device particularly to the type of woven material web to be produced, particularly its thickness.

Particularly good guidance characteristics are achieved when the weaving machine includes a groove-shaped recess above or preferably below the first guide shoulder facing in the running direction of the woven material web, wherein the second guide shoulder faces opposite the running direction of the woven material web engaging in the groove-shaped recess. In principle, the first guide shoulder can be arranged in such a way that the woven material web contacts this guide shoulder from below, so that the groove-shaped recess and the second guide shoulder are then arranged over the first guide shoulder. However, it is more advantageous if the woven material web is supported on the first guide shoulder and is guided downward into the groove-shaped recess in which the second guide shoulder facing opposite the running direction of the woven material web also engages. The second guide shoulder, with its second guide edge, can be adapted to the type of woven material web and to the production conditions in an improved manner when the second guide edge is swivelable around an axis lying parallel to the first guide edge and when the second guide edge is arranged at the guide shoulder by means of a springing holder. When the guide shoulder is inclined at an acute angle relative to the plane of the woven material web at the filling thread set-up edge, an adjustment can be effected in the event of a clamping of the woven material web at the guide device.

It is particularly advisable to provide the second guide shoulder with a heating device, preferably in the area of the guide edge, since the produced woven material web can then be subjected to a first fixing by means of the heating device.

In order to give the woven material web a desired shape, the first and/or second guide edges is/are constructed as a spreading device with deflecting surfaces having grooves for tensioning the woven material web in the lateral direction, wherein a spreading rod is arranged downstream of the guide edge of the second guide shoulder. A heating device provided at the guide edge and/or at the spreading rod can enable the fixing of the aligned woven material web. The alignment of the woven material web at the spreading rod can be additionally benefited by providing a right-handed thread on one half of the spreading rod and a left-handed thread on the other half. It is also possible to arrange the spreading rod so as to be stationary. But a driven construction is also possible.

A construction in which the cutting device includes cutting heads which are arranged at an adjusting device in order to enable a position adjustment in the warp direction of the web is particularly advantageous. It is possible to adapt the cutting process to the weaving process, i.e. to the repeat length of a weave pattern in the woven material web by means of the adjusting device. Thus, for example, in label weaving the weaving speed, and accordingly also the take-off speed, is slower during the weaving of the pattern than in the region between the patterns. The adjusting device makes it possible to adjust the cutting heads in a position along the woven material web such that they constantly cut a region without pattern when the weaving speed, and accordingly also the take-off speed is greater than in the region with pattern.

The roller of the fixing device, may be provided with a rough surface at which the cut woven material web is supported and a heating shoe may be advanced toward the roller. This enables a flawless fixing of the produced ribbons without substantial changes in the shape is particularly advantageous. A stretching of the ribbons in the longitudinal and transverse directions is prevented, per se, by means of the support of the ribbons at the rough surface of the roller. The maintaining of the conformity to shape is additionally reinforced by the contacting of the heating shoe. The rough surface of the roller can be achieved e.g. by means of gluing on granular material such as corundum powder, metal powder and the like. However, it is particularly advantageous if the rough surface of the roller is formed by means of spraying on and melting on metal powder, since the sprayed on and melted on metal powder enters into an intimate connection with the surface and therefore is not influenced by the heating caused by the heating shoe. Particularly good results are obtained when the heating shoe includes a contact surface adapted to the circumferential surface of the roller and when the heating shoe is arranged in a resilient manner at a forward feed member. A construction is also particularly advisable in which the roller is heatable to a temperature, preferably lower than 100° C., which is lower than the temperature of the heating shoe which is preferably at least 130° C.

This construction is particularly advantageous since the pre-heated roller facilitates the fixing particularly in high-speed weaving machines.

Embodiment examples of the weaving machine, according to the invention, are described in more detail with the aid of schematic drawings:

DESCRIPTION OF THE PREFERRED EMBODIMENT

Figure 1:
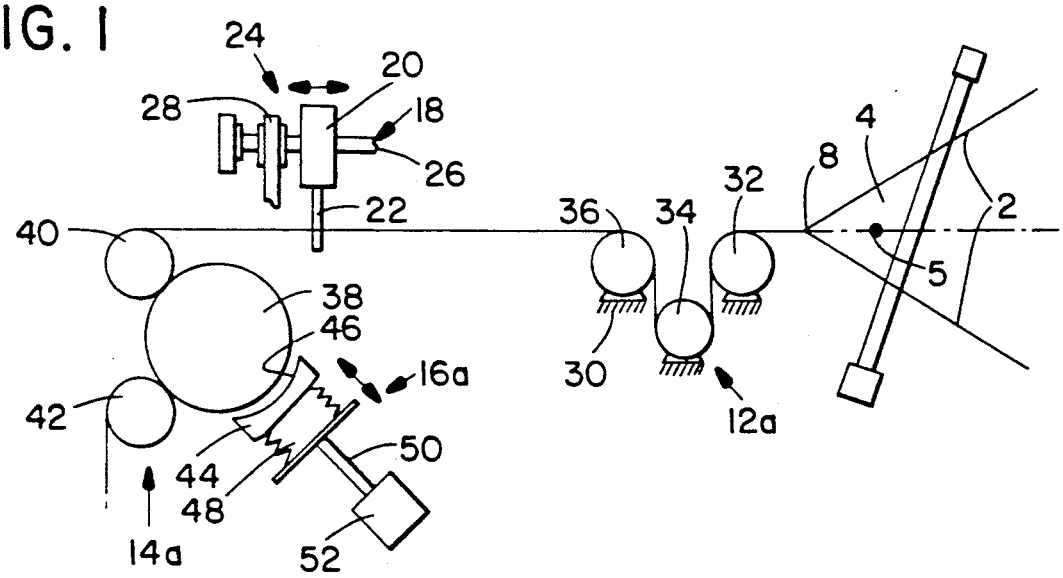
FIG. 1 shows a first weaving machine in a side view of the woven material web guide.
Figure 2:
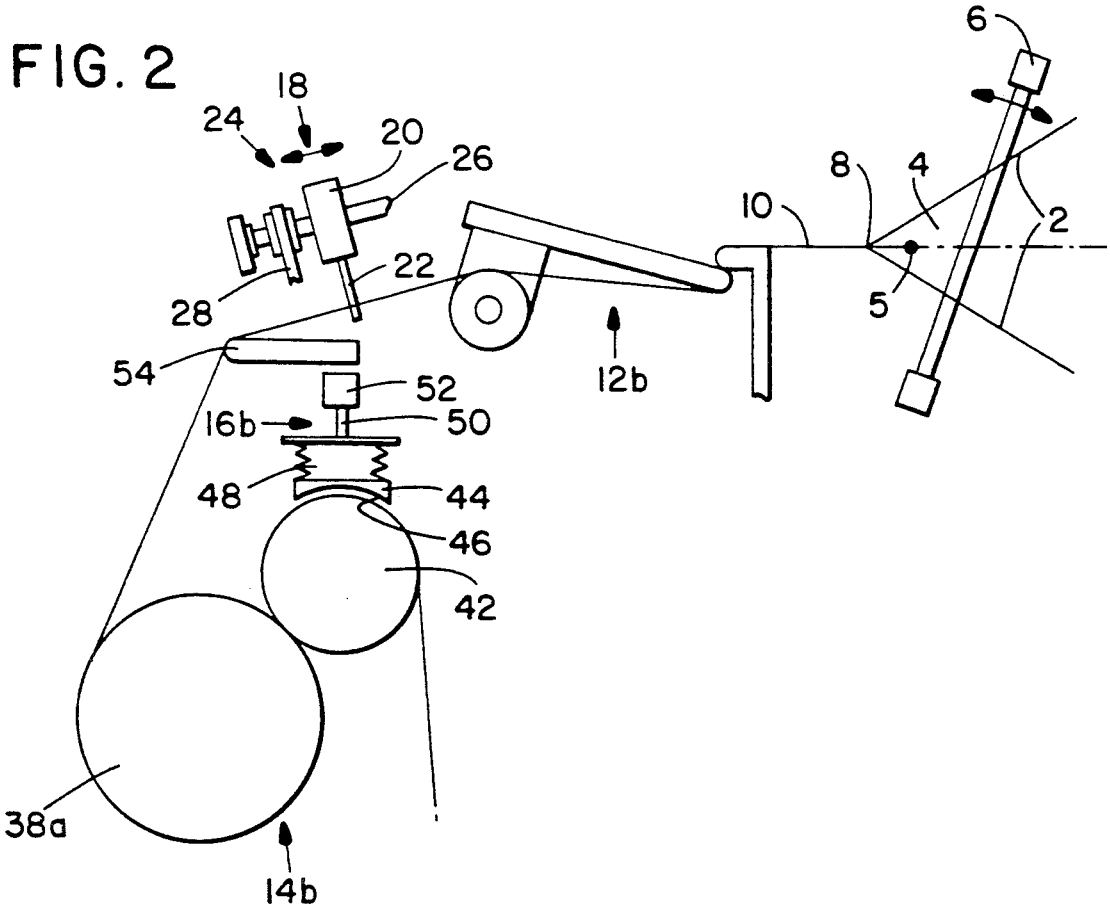
FIG. 2 shows a second weaving machine in a side view of the woven material web guide.

FIGS. 1 and 2 show a schematic view of the parts of the weaving machine substantial to the present invention. All other parts are prior art and sufficiently known. The shed (4) which is formed from the warp threads (2) is shown, a filling thread (5) being inserted in the latter, in a manner not shown, and set up by means of a weaving reed (6) at the set-up edge (8) of the woven material web (10). The woven material web (10) first runs through a guide device (12*a* and 12*b*, respectively) which extends over the woven material web (10). From the guide device (12*a*, 12*b*), the woven material web (10) reaches the take-up device (14*a*, 14*b*) comprising a fixing device (16*a*, 16*b*), a cutting device (18) being arranged prior to the latter. The guide device (12*a*, 12*b*), the cutting device (18) and the fixing device (16*a*, 16*b*) are arranged independently of one another and at a distance from one another at the frame of the weaving machine.

The cutting device (18) is in turn constructed in a known manner and contains various cutting heads (20) with cutting elements (22) which are adjusted individually transversely relative to the woven material web corresponding to the desired width of the ribbons to be produced. The cutting heads can comprise electrically heatable cutting wires or cutting blades. Cutting heads with ultrasonic cutting elements or laser cutting elements are also possible. In this case, the cutting elements are constructed in such a way that they not only enable a cutting of the woven material web, i.e., in practice, a separation of the filling threads between two warp threads, but also simultaneously provide for a ripple-resistant melting on of the cutting edges. For this purpose, the woven material web consists at least partially of thermoplastic threads. For the purpose of the synchronization of the cutting process with a pattern repeat, the cutting heads (20) are connected with a support (28) via adjusting spindles (26) and can thus be adjusted with respect to their position in the direction of the warp threads, i.e. in the running direction of the woven material web. A synchronization of the cutting process with the pattern repeat is accordingly made possible.

In the weaving machine of FIG. 1, the guide device (12*a*) is constructed as a deflecting rod system, wherein the woven material web (10) is guided around three stationary rods (32, 34, 36) connected with the machine frame (30). At least one rod can be constructed so as to be rotatable and at least one rod can be constructed so as to be heatable in order to enable a preliminary fixing of the woven material web.

As was mentioned, the take-up device (14*a*) of the weaving machine FIG. 1 simultaneously also contains the fixing device (16*a*) for the produced ribbons. For this purpose, the roller (38) is provided with a roughened surface which is formed e.g. by means of sprayed on and melted on metal powder. The individual ribbons are made to contact the take-up roller (38) via the guide roller at the input side, which serves as a breast beam (40), and the guide roller (42) on the output side which determines the run-in and run-off locations. A heating shoe (44), which can be advanced toward the take-up roller (38), cooperates with the take-up roller (38); the heating shoe (44), which likewise extends over the woven material web, lies between the run-in and run-off locations of the cut woven material web, preferably in the half loop angle (not shown) of the woven material web, and comprises a contact surface (46) adapted to the circumferential surface of the take-up roller (38). This heating shoe (44) is connected with a forward feed member (50) in a resilient manner via springs (48) so that there results an optimal adapting of the heating shoe (44) to the ribbons to be fixed which lie on the take-up roller. The forward feed member (50) is connected with an adjusting device (52). The heating shoe (44) in turn can be equipped with electric resistance heating, as well as with feelers and controlling means for adjusting the necessary fixing temperature which preferably amounts to at least 130° C. The adjusting device (52) can also be connected to the control unit in order to adjust the pretensioning force of the heating shoe (44).

The weaving machine of FIG. 2 differs the weaving machine of FIG. 1 in that the guide device (12*b*) is constructed as a holding-down device which is explained in more detail in the following in FIGS. 3 and 4. Moreover, the woven material web is guided over a breast beam (54) constructed as a plate after the cutting device (18) and prior to the take-up device (14*b*), the breast beam (54) taking over the function of the breast beam (40) of FIG. 1. The take-up roller (38*a*) is preferably heatable to a temperature of $<100°$ C. in order to preheat the ribbons to be fixed so as to accelerate the fixing at the fixing device (16*b*). The latter is advisably constructed in an analogous manner with respect to the fixing device (16*a*) of FIG. 1 and is heatable to a temperature of $>130°$ C. The fixing device (16*a*) can act at the take-up roller (38*a*), as in FIG. 1, or at the guide roller (42) arranged downstream as in the shown example.

Figure 3:
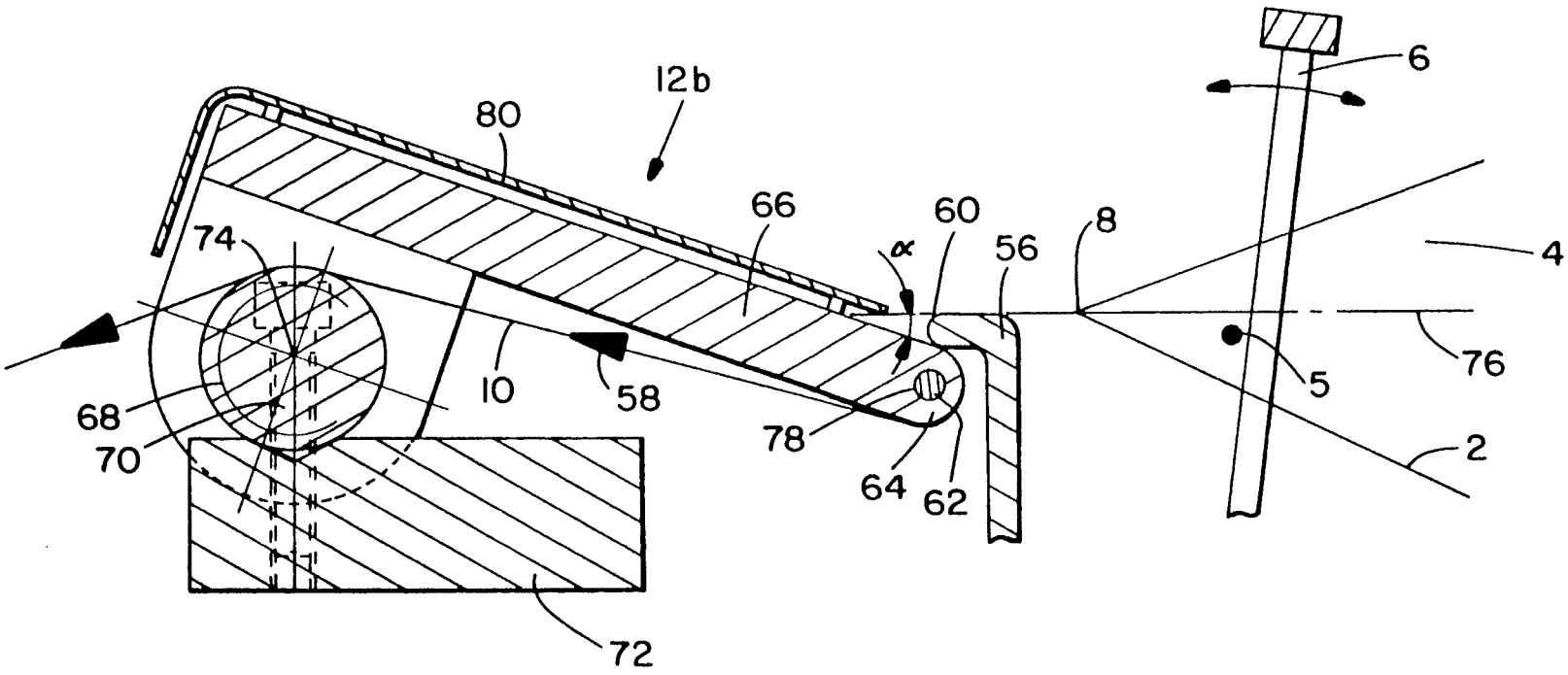
FIG. 3 shows a guide device for the weaving machine of FIG. 2.

FIG. 3 shows a first guide device (12*b*) at the weaving location of the weaving machine, which guide device (12*b*) is constructed as a holding-down device. The warp threads (2) are guided by means of a shedding device, not shown, in such a way as to form the open shed (4) through which the filling thread (5) is inserted and set up at the set-up edge (8) of the woven material web (10) by means of the weaving reed (6). The guide device (12*b*) comprises a first guide shoulder (56), the woven material web (10) being supported on its upper side. The guide shoulder comprises a guide edge (60) which faces in the running direction (58) of the woven material web (10), the woven material web being guided via the guide edge (60) into a groove-like recess (62) located below. The rounded guide edge (64) of a second guide shoulder (66) serves this purpose and guides the woven material web (10) into the recess (62) so that the woven material web is guided in an S-shaped manner. After the second guide edge (64), the woven material web (10) is transported further via a spreading rod (68). The spreading rod (68) lies below the second guide shoulder (66) and is preferably provided in a known manner, not shown in more detail, with a right-handed thread on one half and with a left-handed thread on the other half in order to tension the woven material web in the transverse direction relative to the woven material web. There can also be corresponding thread grooves at the first and/or second guide edge (60, 64). The spreading rod (68) can be arranged so as to be at rest, as in the shown example, or so as to be driven, wherein the circumferential speed must then be greater than the production speed of the woven material web. A drive working in opposite directions is also possible. However, in the present example, the spreading rod (68) is stationary and is fastened at a carrier (72) by means of a screw (70), which carrier (72) also carries the first guide shoulder (56). The second guide shoulder (66) is supported at the spreading rod (68) so as to be swivelable, wherein the axis (74) of the spreading rod, which also forms the swiveling axis of the second guide shoulder (66), lies parallel to the guide edge (60) and (64), respectively. The second guide shoulder (66) is inclined at an acute angle ($\alpha$) relative to the plane (76) of the woven material web (10) at the set-up edge (8), so that a clamping of the woven material web (10) between the guide edges (60, 64) of the first guide shoulder (56) and the second guide shoulder (66) is adjustable when drawing off of the woven material web.

The second guide shoulder (66) contains a heating device (78), at least in the area of the guide edge (64), for the purpose of fixing the woven material web, i.e. for stabilizing the fitting and/or warp threads. The heating action can continue until the spreading rod (68) and be reinforced by means of an insulating cover (80) via the second guide shoulder (66). The spreading rod can also be heatable for determined conditions.

Figure 4:
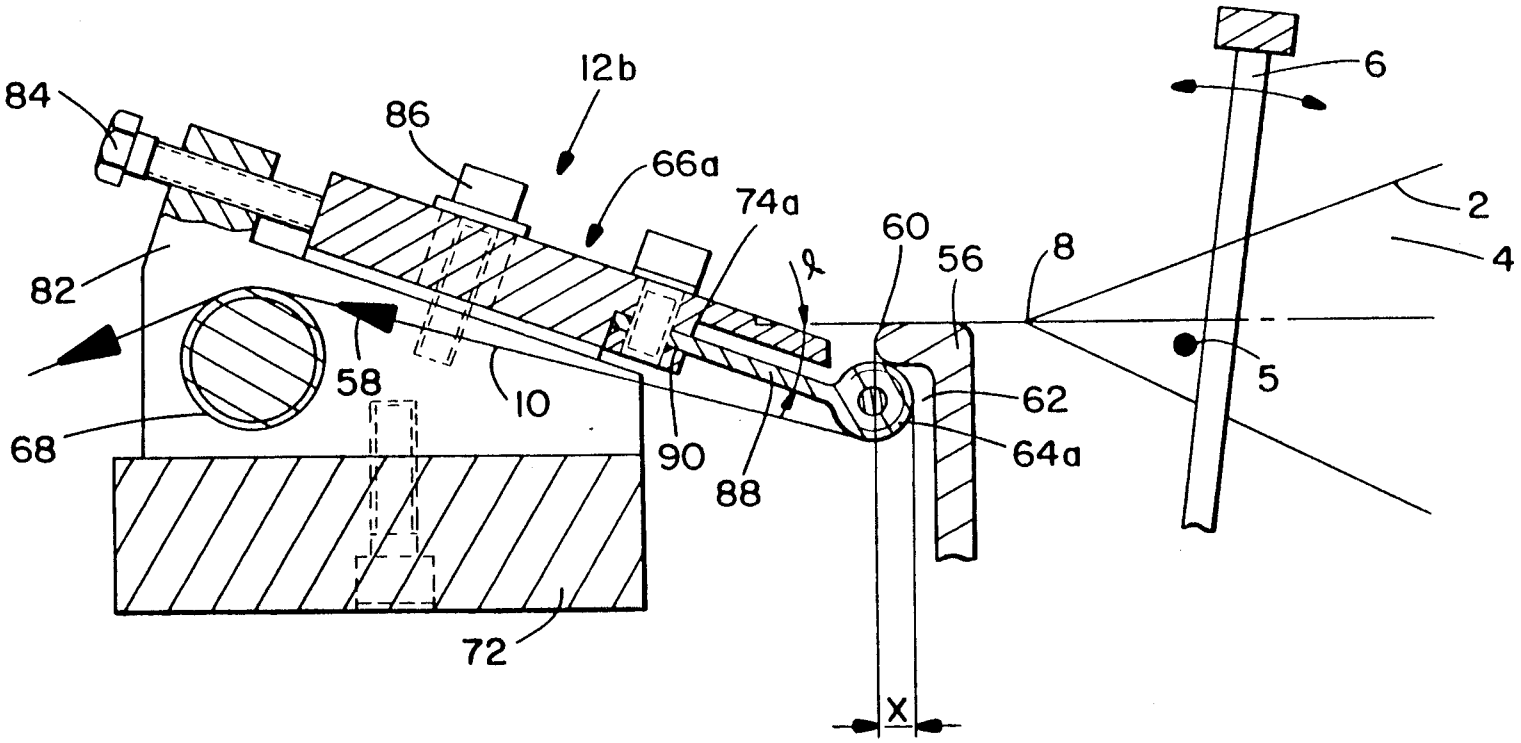
FIG. 4 shows a second guide device for the weaving machine of FIG. 2.

The guide device (12*b*) shown in FIG. 4 corresponds to that of FIG. 3, and the same parts are provided with the same reference numbers. In contrast to the guide device of FIG. 3, the second guide shoulder (66*a*) is arranged at supports (82) in that of FIG. 4, which supports (82) are connected with the carrier (72). The supports also carry the spreading rod (68). The guide shoulder (66*a*) is guided so as to be adjustable at the supports (82) in the running direction (58) of the woven material web by means of adjusting screws (86), so that the overlapping depth (x) of the guide shoulders (66*a*, 60), which act one behind the other, is adjustable. The guide shoulder can be fixed in the respective adjusted overlapping depth (x) by means of the positioning screw (86). The second guide edge (64*a*) is fastened at the second guide shoulder (66*a*) by means of a springing holder (88), so that the second guide edge (64*a*) is swivelable around an axis (74*a*) given by the tightening location (90).

I claim:

1. A weaving machine comprising a guide device (12*a*, 12*b*) for a woven material web (10) and a filling thread set-up edge (8), the guide device (12*a*, 12*b*) being arranged downstream of the filling thread set-up edge (8), a ribbon cutting device (18) for cutting up the woven material web (10), consisting at least partially of thermoplastic threads, into ribbons and for melting on the cut edges so as to be secure against rippling, the cutting device (18) being arranged between the guide device and a breast beam (40, 54), and a thermal fixing device (16*a*, 16*b*) independent of the cutting device (18), wherein the guide device (12*a*, 12*b*) and the cutting device (18) are mounted on the weaving machine independently of one another, and in that the fixing device (16*a*, 16*b*) is arranged on a take-up roller (38, 38*a*) arranged downstream of the breast beam (40, 54) and/or on a guide roller (42) immediately following the take-up roller (38, 38*a*).

2. Weaving machine according to claim 1, wherein the guide device (12*b*) comprises a first guide shoulder (56) which extends along the width of the woven material web (10), the first guide shoulder (56) being arranged downstream of the filling thread set-up edge (8) and having a first guide edge (60); a removable second guide shoulder (66, 66*a*) with a second guide edge (64, 64*a*) being mounted relative to the first guide shoulder (56) such that the woven material web (10) can be guided around the first and second guide shoulders (56, 66, 66*a*) in an S-shaped manner.

3. Weaving machine according to claim 2, wherein the second guide shoulder (66, 66*a*) is formed from individual segments covering a portion of the width of the woven material.

4. Weaving machine according to claim 2 or 3, comprising means for adjusting the overlapping depth (x) of the guide shoulders (56, 66*a*), which engage one behind the other.

5. Weaving machine according to claim 2 or 3, comprising a groove-shaped recess (62) above or preferably below the first guide shoulder (56) facing in the running direction (58) of the woven material web (10), the second guide shoulder (66, 66*a*) facing opposite the running direction (58) of the woven material web (10) engaging in the groove-shaped recess (62).

6. Weaving machine according to claims 2 or 3, wherein the second guide edge (64) is swivelable around an axis (74) lying parallel to the first guide edge (60).

7. Weaving machine according to claim 6, wherein the second guide edge (64*a*) is arranged at the guide shoulder (66*a*) by means of a springing holder (88).

8. Weaving machine according to claims 2 or 3, wherein the guide shoulder (66, 66*a*) is inclined at an acute angle ($\alpha$) relative to the plane (76) of the woven material web (10) at the filling thread set-up edge (8).

9. Weaving machine according to claims 2 or 3, wherein the second guide shoulder (66, 66*a*) comprises a heating device (78), preferably in the area of the guide edge (64, 64*a*).

10. Weaving machine according to claims 2 or 3, wherein the first and/or second guide edge(s) (60, 64, 64*a*) is/are constructed as a spreading device, each guide edge having a deflecting surface with grooves which tension the woven material web (10) in lateral direction.

11. Weaving machine according to claims 2 or 3, wherein a spreading rod (68) is arranged downstream of the guide edge (64, 64*a*) of the second guide shoulder (66, 66*a*).

12. Weaving machine according to claim 11, wherein the spreading rod (68) comprises a right-handed thread on one half and a left-handed thread on the other half.

13. Weaving machine according to claim 11 or 12, wherein the spreading rod (68) is arranged so as to be stationary.

14. Weaving machine according to claim 11 or 12, comprising means for rotating the spreading rod (68) and means for driving the spreading rod (68) at a circumferential speed which is greater than the speed of the web (10).

15. Weaving machine according to claim 1, wherein the guide device (12) comprises a deflecting rod system, wherein three rods (32, 34, 36) are preferably provided which are connected to a machine frame (30) so as to be stationary, and means for rotating at least one rod, and means for heating preferably at least one rod.

16. Weaving machine according to claim 1, wherein the cutting device (18) comprises cutting heads (20) which are arranged at an adjusting device (24) in order to enable a position adjustment in the warp direction of the web (10).

17. Weaving machine according to claim 1, wherein the roller of the fixing device (16*a*, 16*b*) is provided with a rough surface at which the cut woven material web (10) is supported, and means for advancing a heating shoe (44) toward the roller (38, 38*a*, 42).

18. Weaving machine according to claim 17, wherein the rough surface is formed by means of spraying on and melting on metal powder.

19. Weaving machine according to claim 17, wherein the heating shoe (44) comprises a contact surface (46) adapted to the circumferential surface of the roller (38, 38*a*, 42).

20. Weaving machine according to claim 17, wherein the heating shoe (44) is arranged in a resilient manner at a forward feed member (50).

21. Weaving machine according to claim 17, wherein the heating shoe (44) is arranged between run-in and run-up locations of the cut woven material web (10) at the roller (38, 38*a*, 42).

22. Weaving machine according to claim 17, comprising means for heating the roller (38) to a temperature which is lower than the temperature of the heating shoe (44).

23. Weaving machine according to claim 21, wherein the heating shoe 44 is arranged in proximity to the run-up locations.

24. Weaving machine according to claim 22, wherein the temperature of the roller is lower than 100° C. and the temperature of the heating shoe is at least 130° C.

* * * * *